US010522927B2

(12) United States Patent
Yoshida

(10) Patent No.: US 10,522,927 B2
(45) Date of Patent: Dec. 31, 2019

(54) FLOATING CONNECTOR DEVICE

(71) Applicant: KYOCERA CORPORATION, Kyoto (JP)

(72) Inventor: Munenobu Yoshida, Yamato (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/066,625

(22) PCT Filed: Dec. 20, 2016

(86) PCT No.: PCT/JP2016/087977
§ 371 (c)(1),
(2) Date: Jun. 27, 2018

(87) PCT Pub. No.: WO2017/115693
PCT Pub. Date: Jul. 6, 2017

(65) Prior Publication Data

US 2019/0013608 A1 Jan. 10, 2019

(30) Foreign Application Priority Data

Dec. 28, 2015 (JP) ..... 2015-256101

(51) Int. Cl.
*H01R 12/91* (2011.01)
*H01R 13/631* (2006.01)

(52) U.S. Cl.
CPC ..... *H01R 12/91* (2013.01); *H01R 13/631* (2013.01); *H01R 13/6315* (2013.01)

(58) Field of Classification Search
CPC .. H01R 13/631; H01R 13/6315; H01R 13/11; H01R 12/91
(Continued)

(56) References Cited

U.S. PATENT DOCUMENTS 4,334,732 A * 6/1982 Roeschlein ..... H01R 13/6315 439/248
4,591,230 A 5/1986 Roldan
(Continued)

FOREIGN PATENT DOCUMENTS

CN 101361230 A 2/2009
CN 103972696 A 8/2014
(Continued)

OTHER PUBLICATIONS

International Search Report dated Jan. 31, 2017, in corresponding International Application No. PCT/JP2016/087977.

*Primary Examiner* — Edwin A. Leon
*Assistant Examiner* — Milagros Jeancharles
(74) *Attorney, Agent, or Firm* — Duane Morris LLP

(57) ABSTRACT

A floating connector device allows movement of a movable-side housing in board-parallel and pushing directions, allows floating in a pushing/removal direction when mated with a mating connector, and has high contact reliability. A fixed housing (11) includes a long through-hole and a pair of board-facing plates. A movable housing (12) includes an outer portion projecting from the long through-hole and a retaining projection overlapping the board-facing plates in plan view. A contact group includes a tail for board mounting, a fixing portion supported by the fixed housing (11), a U-shaped portion supported by a contact support groove in the outer portion, and an elastic deformation portion, in a free state unsupported by either groove, that by its own elasticity allows the movable housing (12) to sink in a board direction, and in a sunken state, allows elastic movement in a longitudinal direction, a direction orthogonal thereto, and a tilting direction.

4 Claims, 8 Drawing Sheets

(58) Field of Classification Search
USPC ..... 439/246–248
See application file for complete search history.

(56) References Cited

U.S. PATENT DOCUMENTS

| | | | | |
|---|---|---|---|---|
| 5,201,663 | A * | 4/1993 | Kikuchi | H01R 13/6315 439/248 |
| 5,259,779 | A * | 11/1993 | Ooya | H01R 13/6315 29/856 |
| 5,306,168 | A * | 4/1994 | Kunishi | H01R 13/6315 439/248 |
| 6,390,828 | B1 * | 5/2002 | Yamaguchi | H01R 13/631 439/247 |
| 7,374,432 | B2 | 5/2008 | Koguchi et al. | |
| 7,887,350 | B2 * | 2/2011 | Fukazawa | H01R 12/707 439/247 |
| 8,257,095 | B2 * | 9/2012 | Akai | H01R 12/716 439/248 |
| 9,048,601 | B2 * | 6/2015 | Kimura | H01R 24/60 |
| 9,088,113 | B2 | 7/2015 | Funayama et al. | |
| 9,178,326 | B2 | 11/2015 | Funayama et al. | |
| 9,281,594 | B2 | 3/2016 | Funayama et al. | |
| 9,484,656 | B2 * | 11/2016 | Doi | H01R 12/65 |
| 9,735,531 | B2 * | 8/2017 | Zhu | H01R 24/542 |
| 10,230,187 | B2 * | 3/2019 | Hasegawa | H01R 12/91 |
| 2006/0276061 | A1 | 12/2006 | Koguchi et al. | |
| 2008/0296133 | A1 * | 12/2008 | Ura | H01R 13/6315 200/1 A |
| 2009/0239421 | A1 * | 9/2009 | Fukazawa | H01R 12/716 439/660 |
| 2009/0239422 | A1 * | 9/2009 | Fukazawa | H01R 12/716 439/660 |
| 2011/0294326 | A1 * | 12/2011 | Tanaka | H01R 12/712 439/248 |
| 2012/0003875 | A1 | 1/2012 | Akai et al. | |
| 2012/0135621 | A1 * | 5/2012 | Hayauchi | H01R 13/6275 439/247 |
| 2014/0213115 | A1 | 7/2014 | Kimura | |
| 2015/0044917 | A1 * | 2/2015 | Takaki | H01R 12/70 439/733.1 |
| 2015/0064935 | A1 * | 3/2015 | Funayama | H01R 12/91 439/1 |
| 2015/0064975 | A1 | 3/2015 | Funayama et al. | |
| 2015/0132999 | A1 * | 5/2015 | Sato | H01R 24/60 439/676 |
| 2015/0244093 | A1 | 8/2015 | Funayama et al. | |
| 2015/0270658 | A1 * | 9/2015 | Aoki | H01R 4/48 439/660 |
| 2016/0294111 | A1 * | 10/2016 | Kobayashi | H01R 13/187 |
| 2017/0338592 | A1 * | 11/2017 | Doi | H01R 13/6315 |
| 2018/0026384 | A1 * | 1/2018 | Shibuya | H01R 12/737 439/637 |
| 2018/0241155 | A1 * | 8/2018 | Suzuki | H01R 13/7032 |

FOREIGN PATENT DOCUMENTS

| | | | |
|---|---|---|---|
| CN | 104584331 | A | 4/2015 |
| EP | 0549960 | A2 | 7/1993 |
| JP | H05-023429 | U | 3/1993 |
| JP | 2004-134156 | A | 4/2004 |
| JP | 2007-018785 | A | 1/2007 |
| JP | 2007-165128 | A | 6/2007 |
| JP | 2007-265742 | A | 10/2007 |
| JP | 5023545 | B2 | 6/2012 |
| JP | 2013-016363 | A | 1/2013 |

* cited by examiner

FLOATING CONNECTOR DEVICE

CROSS-REFERENCE TO RELATED APPLICATION

The present application claims priority to and the benefit of Japanese Patent Application No. 2015-256101 filed Dec. 28, 2015, the entire contents of which are incorporated herein by reference.

TECHNICAL FIELD

The present disclosure relates to a floating connector device mainly used as a board-to-board connector.

BACKGROUND

A floating connector device is used for facilitating the mating of a plug connector and a receptacle connector, respectively fixed to a pair of boards, by absorbing positional error of the connectors. Either the plug connector or the receptacle connector is formed by a fixed housing (fixed insulator) fixed to a board and a movable housing (movable insulator) that is movable relative to the fixed housing. One end of a contact group is fixed to the board, and the other end is fixed to the movable housing. In other words, the movable housing is connected to the fixed housing via the contact group and can move relative to the fixed housing by the elasticity of the contact group, as in patent literature (PTL) 1, 2.

For such a floating connector device, PTL 2 proposes a technique for restricting the movement range (range of motion) of the movable housing with movement restricting brackets to prevent plastic deformation of the contact group due to excessive movement of the movable housing.

CITATION LIST

Patent Literature

PTL 1: JP2007265742A
PTL 2: JP201316363A

SUMMARY

Technical Problem

By fixing a pair of movement restricting brackets on the fixed housing in a positional relationship to clamp the movable housing, the floating connector device of PTL 2 simultaneously restricts the movement range in the alignment direction of the contacts of the movable housing and promotes retention of the movable housing. PTL 2, however, focuses on enabling the movable housing to move in a direction parallel to the board (XY direction), whereas the degree of freedom in the pushing direction (Z direction) when attaching/removing the movable housing to/from the mating connector is low. Floating is also insufficient after mating to the mating connector.

The present disclosure aims to obtain a floating connector device that can increase the range of motion of a movable-side housing not only in the direction parallel to the board but also in the pushing direction, and moreover that allows floating in the pushing and removal direction without a contact portion of the contact group sliding (moving relatively) after mating to the mating connector and that has high contact reliability.

Solution to Problem

A floating connector device according to the present disclosure comprises a fixed housing for fixing to a board, a movable housing movable with respect to the fixed housing, and a contact group with one end for fixing in a row to the board and another end for fixing in a row to the movable housing in a longitudinal direction of the movable housing; wherein the fixed housing comprises a long through-hole and a pair of board-facing plates, positioned at longitudinal ends of the long through-hole, facing the board; the movable housing comprises an outer portion projecting from the long through-hole of the fixed housing and a retaining projection positioned farther on the board side than the board-facing plates and overlapping the board-facing plates in plan view; the contact group comprises a tail for mounting on a board, a fixing portion supported by a storage fixing groove of the fixed housing, a U-shaped portion supported by a contact support groove formed in the outer portion of the movable housing, and an elastic deformation portion, connecting the fixing portion and the U-shaped portion, in a free state unsupported by either groove; and the elastic deformation portion, by elasticity thereof in the free state, separates the movable housing from the board, allows the movable housing to sink in a direction of the board, and in a sunken state, allows elastic movement in the longitudinal direction of the movable housing, a direction orthogonal to the longitudinal direction, and a tilting direction.

In a preferred embodiment, a retaining bracket positioned on an inside of the board-facing plates is positioned on the fixed housing, and the retaining bracket comprises a pair of tails for mounting on a board, a pair of fixing portions extending along an inner surface of the fixed housing, and a retaining plate connecting the pair of fixing portions and overlapping with the retaining projection of the movable housing in plan view.

A mating connector comprising a contact group for connecting to the contact group of the floating connector device preferably comprises elastic deformation portions forming a pair including tip contact portions to elastically contact both sides of the U-shaped portion of the contact group at different height positions.

In a preferred embodiment, the elastic deformation portion of the contact group comprises an inverted U-shaped portion, a diagonally downward extension, a U-shaped fold, and a diagonally upward extension in this order from a fixing portion side that fixes to the fixed housing.

The contact group preferably further comprises a floating deforming portion, between the fixing portion that fixes to the fixed housing and the inverted U-shaped portion, separated from a bottom of the storage fixing groove of the fixed housing.

Advantageous Effect

The present disclosure can obtain a floating connector device that can increase the range of motion of a movable-side housing not only in the direction parallel to the board but also in the pushing and removal direction, and moreover that allows floating in the pushing and removal direction after mating to a mating connector and that has high contact reliability.

DETAILED DESCRIPTION

Figure 5:
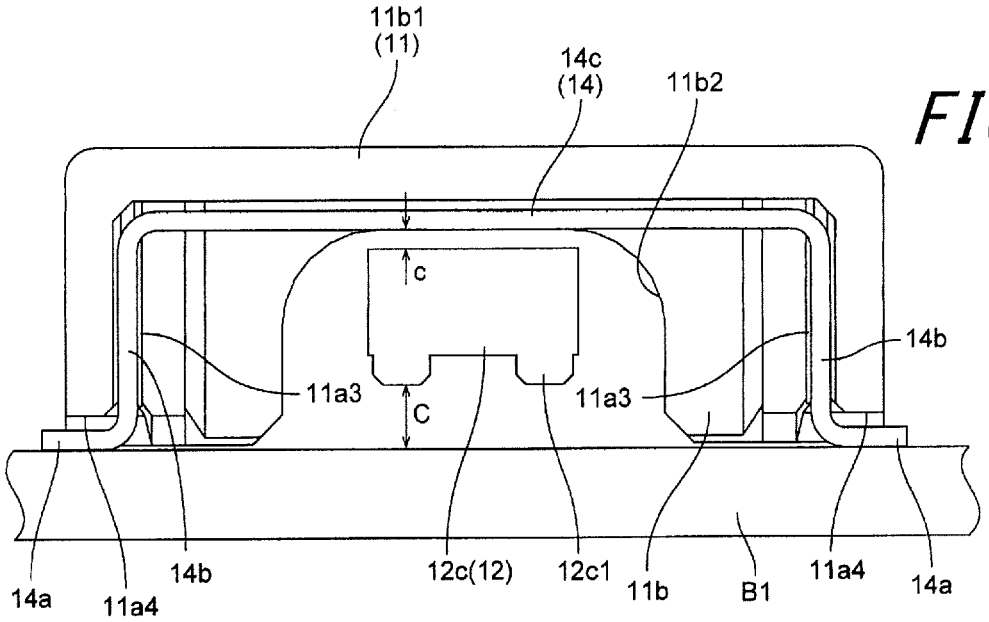
FIG. 5 is a cross-sectional view along the V-V line in FIG. 1.
Figure 6:
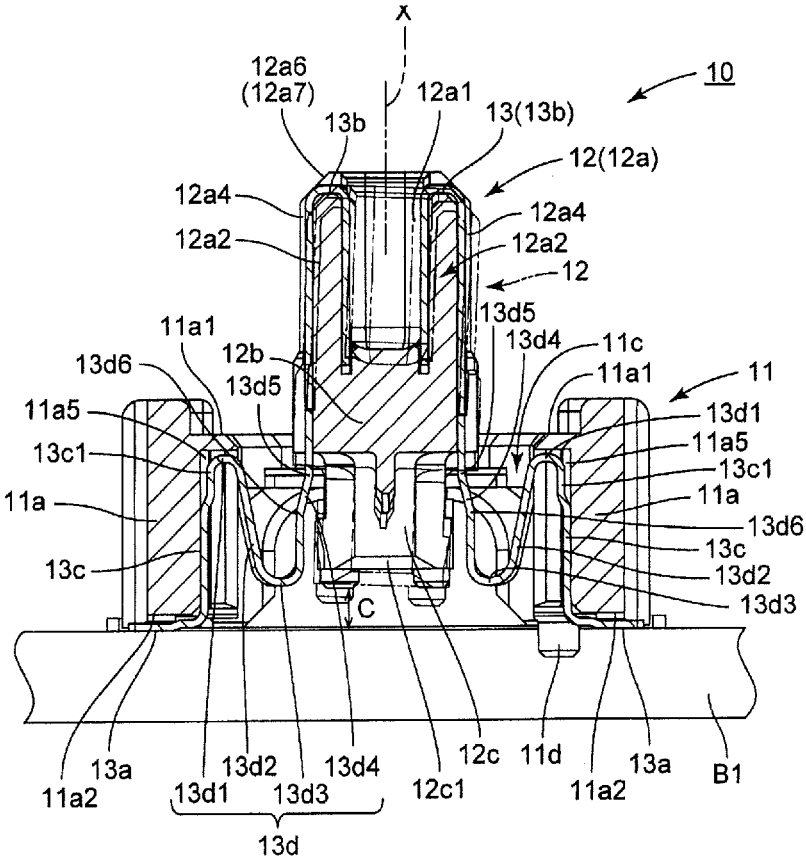
FIG. 6 is a cross-sectional view along the VI-VI line in FIG. 1.
Figure 7:
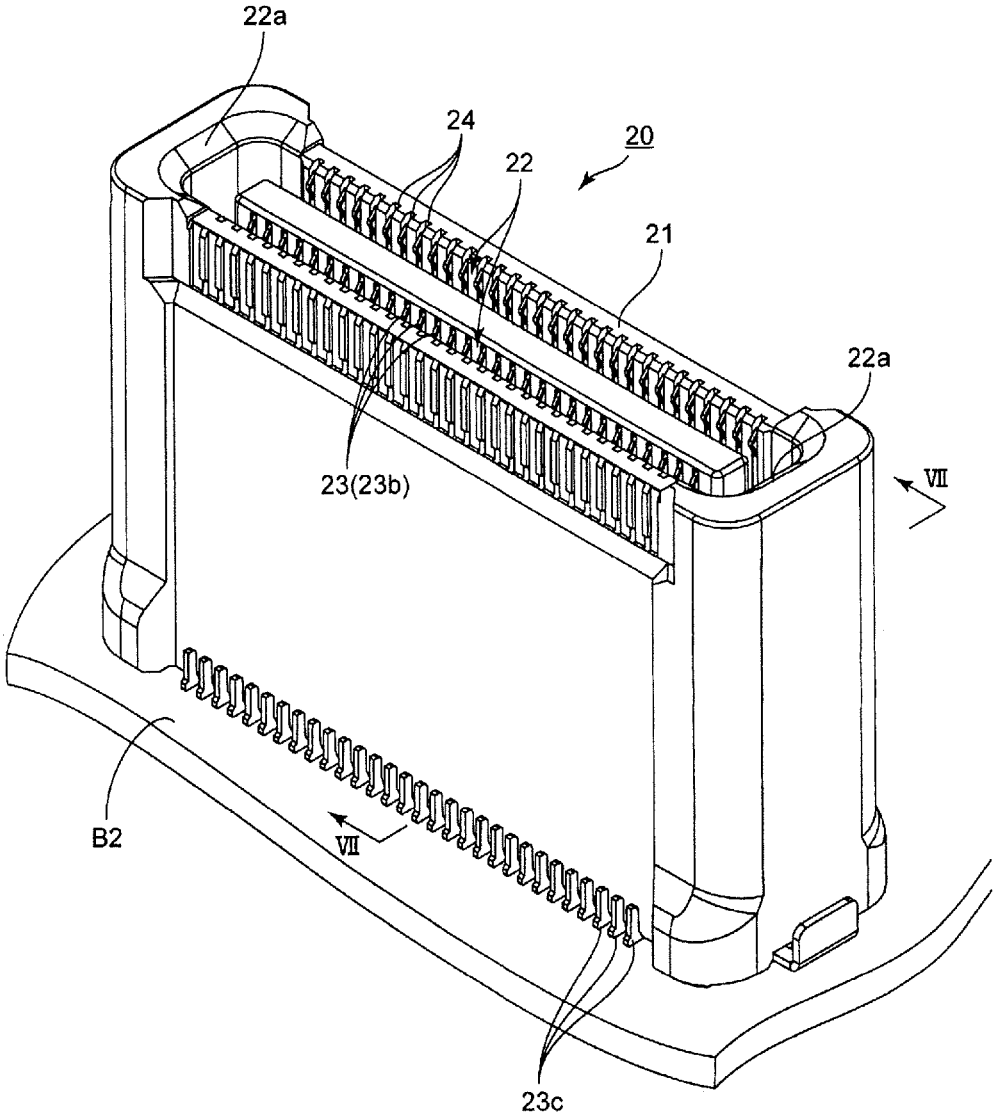
FIG. 7 is a perspective view of an embodiment of a receptacle connector for coupling to the plug connector of FIG. 1 through FIG. 6, illustrating an embodiment of a floating connector device according to the present disclosure.
Figure 8:
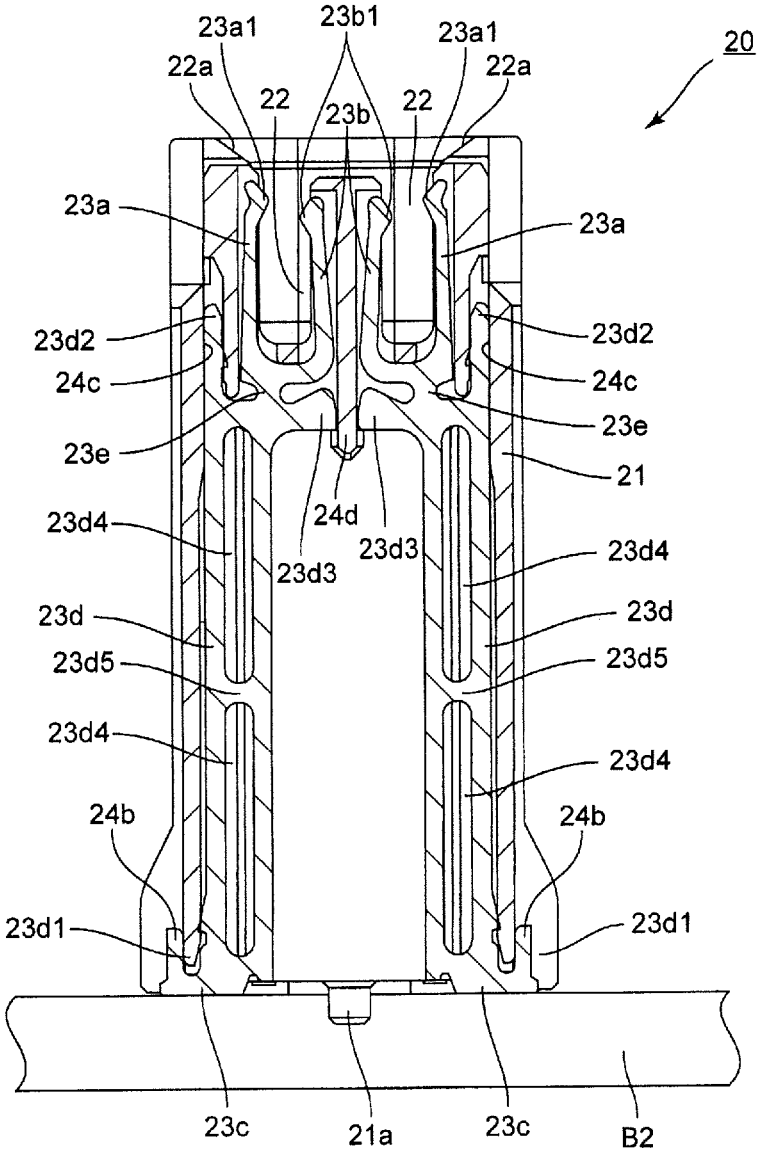
FIG. 8 is a cross-sectional view along the VII-VII line in FIG. 7.
Figure 9:
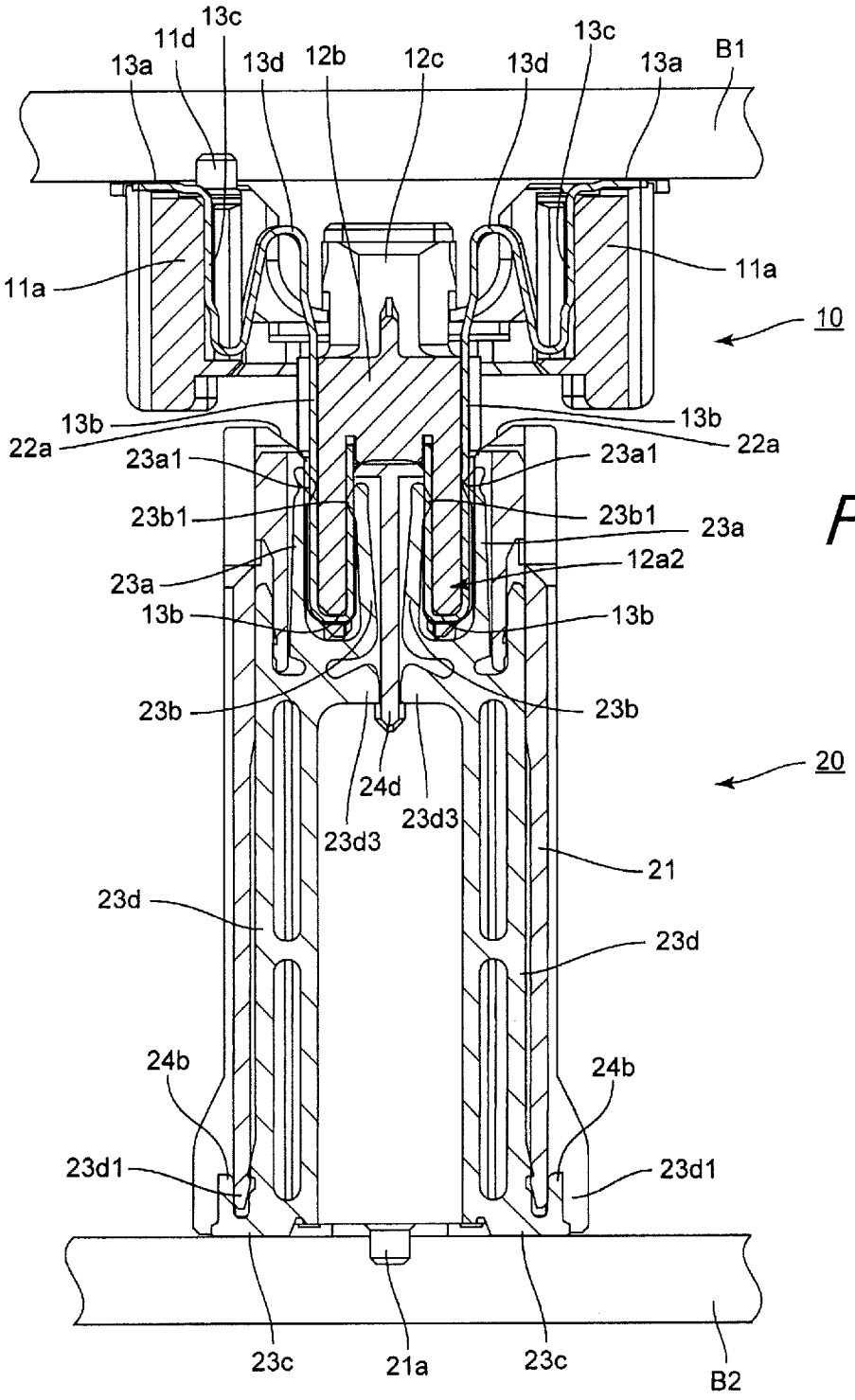
FIG. 9 is a cross-sectional view corresponding to FIG. 6 and FIG. 8, illustrating a state of connection between the plug connector in FIG. 1 through FIG. 6 and the receptacle connector in FIG. 7 and FIG. 8.

A connector (plug connector in the present embodiment) 10 illustrated in FIG. 1 through FIG. 6 and FIG. 9 and a connector (receptacle connector in the present embodiment) 20 illustrated in FIG. 7 through FIG. 9 are connected by mating. Of these two connectors, the plug connector 10 is illustrated in the present embodiment as being a floating connector device. In the present embodiment, a first board B1 (circuit board, control board) and a second board B2 (circuit board, control board) are parallel in a regular state (design state). A wiring circuit on the first board B1 is mounted on and coupled to a plug contact 13 group of the plug connector 10 in advance. A wiring circuit on the second board B2 is mounted on and coupled to a receptacle contact 23 group of the receptacle connector 20 in advance.

As illustrated in FIG. 1 through FIG. 6, the plug connector 10 includes a fixed (guide) housing (fixed insulator) 11 mounted on the first board B1, a movable housing (movable insulator) 12 supported movably by the fixed housing 11, and a plug contact 13 group mounted between the movable housing 12 and the first board B1. The alignment direction of the plug contact 13 group is the longitudinal direction of the plug connector 10 (fixed housing 11 and movable housing 12). In the present embodiment, the plug connector 10 and the receptacle connector 20 are symmetrical relative to an up-down center line (plane) X (FIG. 6) along the longitudinal direction. The direction away from the first board B1 (second board B2) is upward.

Figure 1:
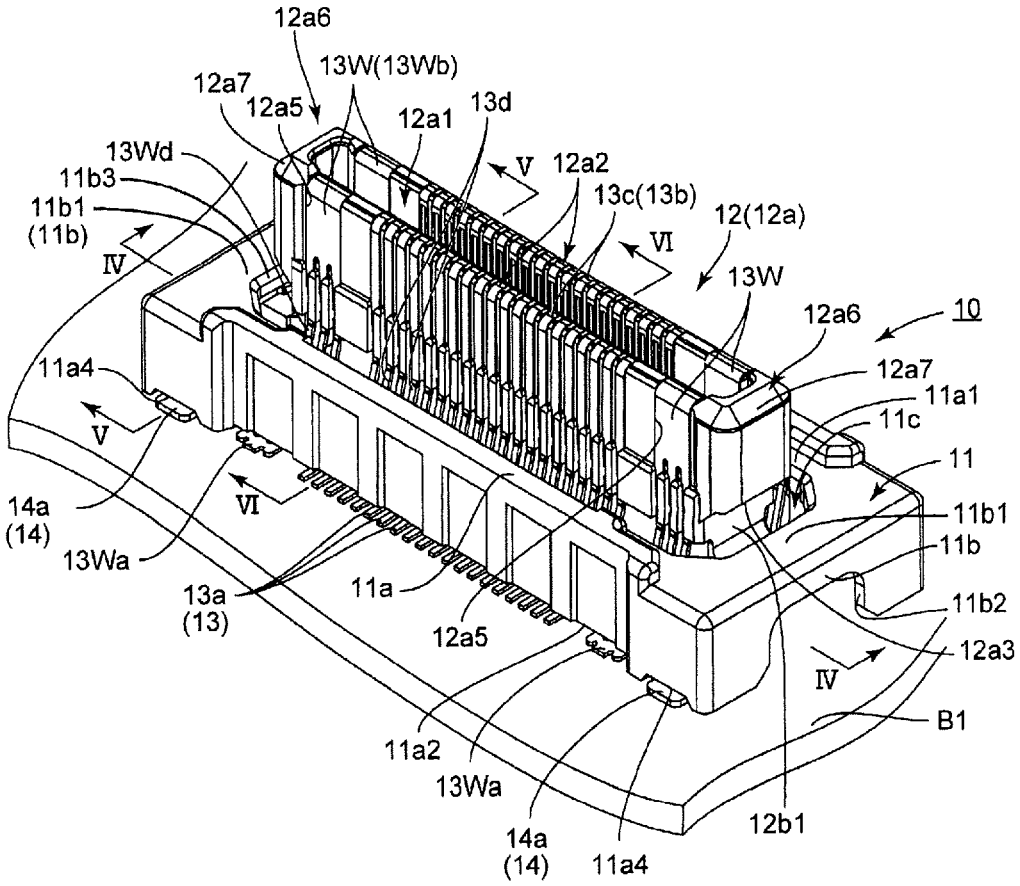
FIG. 1 is a perspective view of a plug connector (floating connector) alone, illustrating an embodiment of a floating connector device according to the present disclosure.
Figure 2:
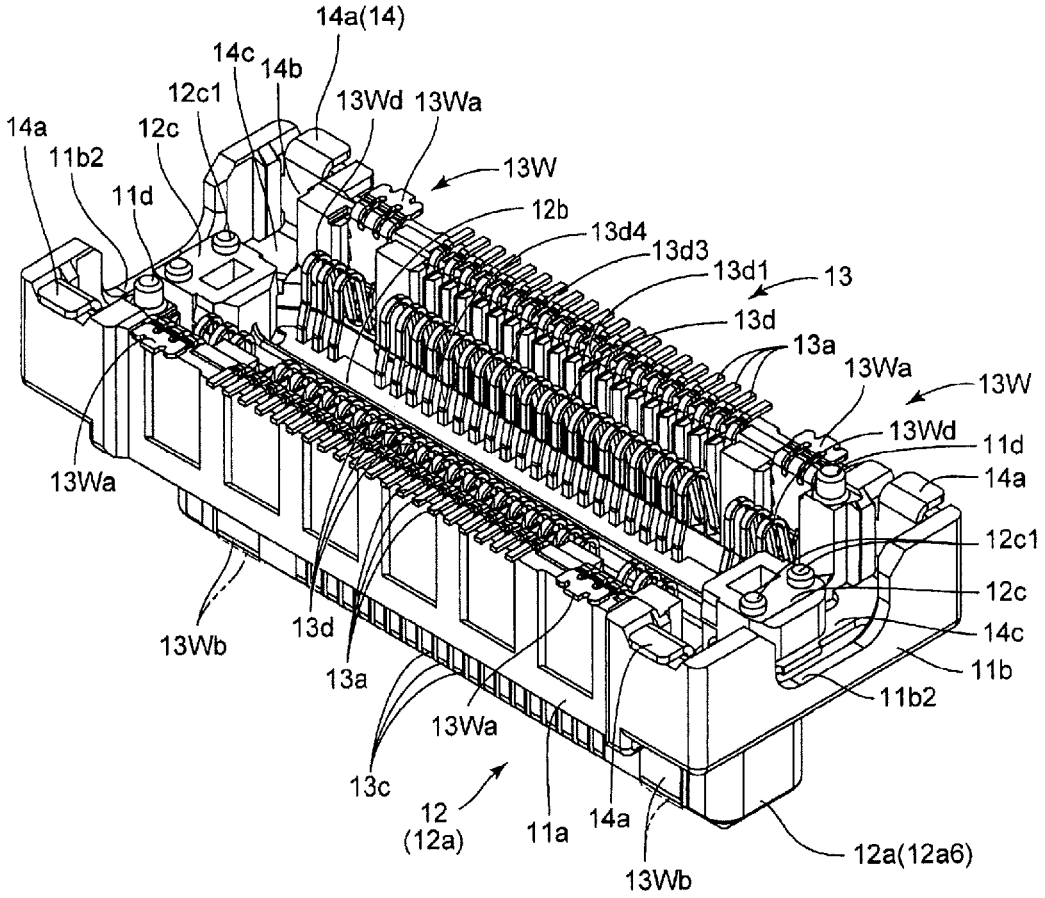
FIG. 2 is a perspective view from the opposite direction of the same plug connector alone.
Figure 3:
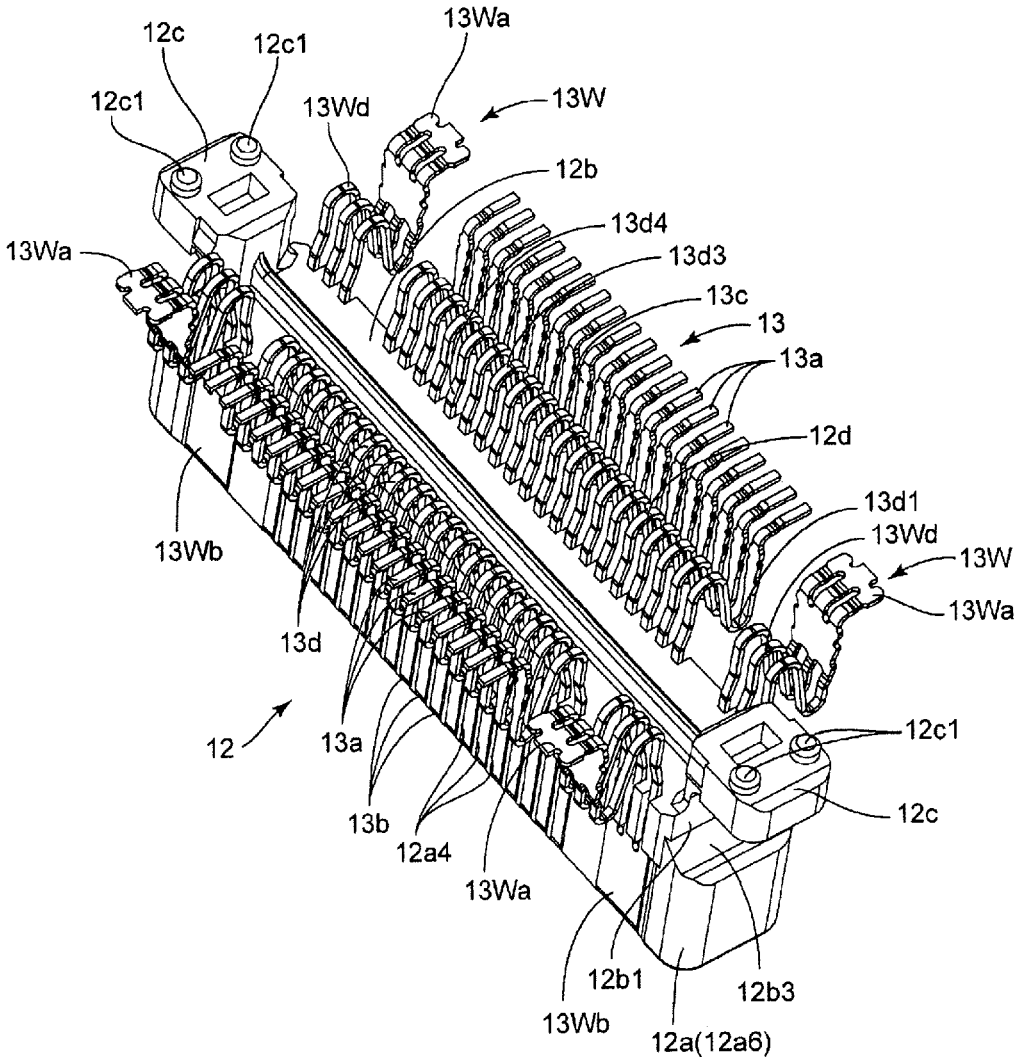
FIG. 3 is a perspective view from the opposite direction of a movable housing of the same plug connector.

The fixed housing 11 has the shape of a planar rectangular frame that includes a pair of parallel longitudinal walls 11*a* in the longitudinal direction rising from the first board B1 and a pair of parallel transverse walls 11*b* in the transverse direction connecting the ends of the pair of longitudinal walls 11*a*. The longitudinal walls 11*a* and the transverse walls 11*b* have the same height. An opening restriction edge (projection) 11*a*1 facing inward is formed near the upper end of the longitudinal walls 11*a* (FIG. 1, FIG. 6). A board-facing plate (board parallel plate) 11*b*1 facing inward is formed at the upper end of the transverse walls 11*b*. A long through-hole 11*c* (FIG. 1) is formed by the opening restriction edges (projections) 11*a*1 and the board-facing plates 11*b*1. A cutout 11*a*2 exposing a tail 13*a* of the plug contact 13 is formed in a portion of the longitudinal wall 11*a* along the first board B1 at the central portion in the longitudinal direction. An opening 11*b*2 is formed at the central portion of the transverse wall 11*b* on the first board B1 side. A positioning projection 11*d* for positioning to the first board B1 is formed on a portion of the lower end of the longitudinal wall 11*a* of the fixed housing 11 (FIG. 2, FIG. 6).

At both longitudinal ends of the fixed housing 11, a substantially U-shaped retaining bracket 14 is positioned on the inner surface of the pair of longitudinal walls 11*a* and the board-facing plate 11*b*1 of the transverse wall 11*b*. This retaining bracket 14 has a pair of tails 14*a* mounted (soldered) to the first board B1, a fixing portion 14*b* that rises from each tail 14*a* and fits in a storage fixing groove 11*a*3 (FIG. 5) on the inner surface of the longitudinal wall 11*a*, and a retaining plate 14*c* that connects the upper ends of the pair of fixing portions 14*b*. The retaining plate 14*c* is disposed along the inner surface of the board-facing plate 11*b*1. A cutout 11*a*4 exposing the tail 14*a* is formed on the longitudinal wall 11*a*.

The movable housing 12 includes an outer portion 12*a* positioned (projecting) on the outside of the fixed housing 11 and an inner portion 12*b* extending from the outer portion 12*a* into the long through-hole 11*c*. At both longitudinal ends of the inner portion 12*b*, a stopper face 12*b*1 for restricting the movement end of the movable housing 12 in the longitudinal direction is formed facing the board-facing plate 11*b*1 (the inner surface of the long through-hole 11*c*) of the fixed housing 11.

At both longitudinal ends of the inner portion 12*b*, a pair of retaining projections 12*c* are formed at a position below the board-facing plate 11*b*1 of the fixed housing 11 and the retaining plate 14*c* of the retaining bracket 14 (in a regular state, a portion of the tip overlaps with the board-facing plate 11*b*1 and the retaining plate 14*c* in plan view). An escape space 12*d* in which the board-facing plate 11*b*1 can move freely is formed between the outer portion 12*a* and the retaining projection 12*c*. In a regular state, the upper surface of the retaining projection 12*c* opposes the retaining plate 14*c* of the retaining bracket 14 with a clearance c (FIG. 5). The size of this clearance c is, for example, 0.15 mm. Stopper projections 12*c*1 for restricting the downward movement end of the movable housing 12 are formed on the lower end of the retaining projection 12*c*, facing the first board B1. A gap C between the stopper projections 12*c*1 and the first board B1 is, for example, 0.6 mm (FIG. 5, FIG. 6). The gap C is preferably larger than the clearance c but may be identical to or smaller than the clearance c.

In other words, the amount of movement (movement end) of the movable housing 12 in the longitudinal direction is restricted by the position of abutment with the stopper face 12*b*1 and the inner surface of the board-facing plate 11*b*1. The amount of movement (movement end) in the left-right direction is restricted by the position of abutment with the outer surface of the inner portion 12*b* and the opening restriction edge (projection) 11*a*1. The amount of movement (movement end) upward is restricted by the position of abutment between the upper surface of the retaining projections 12*c* and the retaining plate 14*c* of the retaining brackets 14. The amount of movement (movement end) downward is restricted by the position of abutment between the stopper projections 12*c*1 of the retaining projections 12*c* and the first board B1.

A long bottomed hole 12*a*1 extending in the longitudinal direction is formed in the central portion in the transverse direction of the outer portion 12*a*. Longitudinal direction plates at both ends of this long bottomed hole 12*a*1 form a pair of insertion plates 12*a*2. Contact support grooves 12*a*4 for insertion and fixing of a row of plug contacts 13 are formed in a row on the inside and outside of the insertion plates 12*a*2. A U-shaped portion 13*b* of the plug contact 13 is inserted and fixed to each contact support groove 12*a*4.

A guiding projection 12*a*6 that projects upward and sideways is formed at both longitudinal ends of the outer portion 12*a*. A guiding inclined face 12*a*7 is formed on the outer surface at the upper end. A tapered face 12*a*3 that is positioned below the guiding projection 12*a*6 and decreases in longitudinal width (length) towards the inner portion 12*b* is formed in the escape space 12*d* below the longitudinal ends of the outer portion 12*a* of the movable housing 12.

On the other hand, a chamfered portion 11*b*3 opposing the tapered face 12*a*3 is formed in the transverse wall 11*b* of the fixed housing 11 on the inner edge of the board-facing plate 11*b*1 that opposes the tapered face 12*a*3. The tapered face 12*a*3 and the chamfered portion 11*b*3 are normally not in contact, but when the movable housing 12 relatively moves and swings excessively, the tapered face 12*a*3 and the chamfered portion 11*b*3 can come into surface contact to restrict the swinging.

Two rows of plug contacts 13 are provided along with a pair of insertion plates 12*a*2 (corresponding to the pair of longitudinal walls 11*a* of the fixed housing 11). Each plug contact 13 includes the above-described tail 13*a* (FIG. 6) mounted on the first board B1, a fixing portion 13*c* that fits in storage fixing grooves 11*a*5 formed in a row on the inner surface of the longitudinal wall 11*a* of the fixed housing 11, and an elastic deformation portion 13*d* continuous with the above-described U-shaped portion 13*b*. A floating deforming portion 13*c*1 connecting the upper end of the fixing portion 13*c* smoothly to the elastic deformation portion 13*d* is formed on the upper end of the fixing portion 13*c* separated from the bottom of the storage fixing groove 11*a*5.

The elastic deformation portion 13*d* is a portion that does not engage with (is not inserted into) any support groove (deformation suppressing groove), including the storage fixing groove 11*a*5 of the fixed housing 11 and the contact support groove 12*a*4 of the movable housing 12, and can freely deform elastically. The elastic deformation portion 13*d* includes an inverted U-shaped portion 13*d*1, a diagonally downward extension 13*d*2, a U-shaped fold 13*d*3, and a diagonally upward extension 13*d*4 in this order from the fixing portion 13*c* (floating deforming portion 13*c*1) side. Elastic deformation of this elastic deformation portion 13*d* (particularly the inverted U-shaped portion 13*d*1, U-shaped fold 13*d*3, and diagonally upward extension 13*d*4) allows floating in the up-down direction, longitudinal direction, and left-right direction of the movable housing 12 and also in a rotation direction about (a location near) the plane center of the movable housing 12.

A wide U-shaped portion 13Wb of a wide plug contact 13W is positioned on the movable housing 12 at the ends of the plug contacts 13 positioned in a row. This wide plug contact 13W can be used as a ground terminal or a power source terminal. A wide contact support groove 12*a*5 for insertion of the U-shaped portion 13Wb is formed in the insertion plate 12*a*2. A tail 13Wa of the wide plug contact 13W is also wide. However, an elastic deformation portion 13Wd positioned between the tail 13Wa and the U-shaped portion 13Wb is divided into narrow portions of the same width as the elastic deformation portion 13*d* of another plug contact (signal contact) 13. Accordingly, the wide plug contact 13W does not interfere with elastic deformation of the movable housing 12.

The plug connector 10 is thus structured so that when no external force is applied to the movable housing 12, the movable housing 12 is correctly positioned at the center of the fixed housing 11 by the elastic force of the plug contact 13, 13W group positioned symmetrically with respect to the central plane X. The pair of retaining projections 12*c* at the ends thereof are positioned symmetrically below the board-facing plate 11*b*1 of the fixed housing 11. The upper surface of the retaining projections 12*c* opposes the retaining plate 14*c* of the retaining bracket 14 with the clearance c (FIG. 5).

The receptacle connector 20 includes an insulator housing 21 in the shape of a rectangular parallelepiped having a planar shape slightly larger than the outer portion 12*a* of the movable housing 12 in plan view, as illustrated in FIG. 7 through FIG. 9. A pair of receptacle recesses 22 for receiving the pair of insertion plates 12*a*2 of the movable housing 12 is formed in the housing 21. A row of storage grooves 24 for receiving the receptacle contacts 23 is formed in the receptacle recesses 22. Guiding inclined faces 22*a*, corresponding to the guiding projection 12*a*6 and the guiding inclined face 12*a*7 formed on the outer surface at the upper end of the outer portion 12*a* of the movable housing 12, are formed at the entrances to the receptacle recesses 22. A positioning projection 21*a* is formed at the end of the housing 21 on the second board B2 side.

The receptacle contacts 23 stored in the pair of receptacle recesses 22 have the same (horizontal inversion) shape. The receptacle contact 23 has elastic deformation portions 23*a*, 23*b* projecting from the opposing inner surfaces of the receptacle recesses 22, a tail 23*c* soldered to the second board B2, and a connection fixing portion 23*d* that connects the elastic deformation portions 23*a*, 23*b* and the tail 23*c*. The elastic deformation portions 23*a*, 23*b* and the connection fixing portion 23*d* are connected by a constricted (narrow) linking portion 23*e*. The elastic deformation portions 23*a*, 23*b* are positioned inside a deformation allowance groove 24*a* that faces the opposing inner surfaces of the receptacle recesses 22. The positions of tip contact portions 23*a*1, 23*b*1 in the depth direction of the receptacle recesses 22 differ from each other. The elastic deformation portion 23*a* (tip contact portion 23*a*1) and the elastic deformation portion 23*b* (tip contact portion 23*b*1) elastically contact both sides of the U-shaped portion 13*b* of the plug contact 13 when the insertion plates 12*a*2 of the movable housing 12 are inserted in the receptacle recesses 22. By varying the positions of tip contact portions 23*a*1, 23*b*1 in the depth direction of the receptacle recesses 22, the tip contact portions 23*a*1, 23*b*1 contact (abut) the U-shaped portion 13*b* at different times when inserted and fit into the plug contacts 13. This mitigates the insertion force. Furthermore, the probability of contact failure when a foreign object adheres to the U-shaped portion 13*b* of the plug contacts 13 is reduced by the U-shaped portion 13*b* being clamped from both sides. The position of either one of the tip contact portions 23*a*1, 23*b*1 in the depth direction of the receptacle recesses 22 may be shallower, but the position of the tip contact portion 23*a*1 on the outside is preferably shallower from the perspective of guiding the fitting.

The elastic deformation portions 23*a*, 23*b* can not only elastically deform alone in the contact and separation direction, but they can also elastically move integrally in a plane that includes the contact and separation direction by elastic deformation of the linking portion 23*e*.

The connection fixing portion 23*d* has two slits 23*d*4 that are separated in the longitudinal direction (up-down direction). Since the connection fixing portion 23*d* is divided by the slits 23*d*4 into two conductive portions extending in the longitudinal direction, the high-frequency characteristics improve. One slit 23*d*4 or three or more in a line may be included, but inclusion of a connecting portion 23*d*5 between slits 23*d*4 ensures strength.

The housing 21 (storage grooves 24) and the receptacle contacts 23 are provided with a fixing structure that allows the above-described elastic deformation of the elastic deformation portions 23*a*, 23*b* of the receptacle contacts 23 while reliably fixing the connection fixing portion 23*d* to the housing 21. In other words, a fixing projection 24*b* and a fixing recess 23*d*1 are formed on the tail 23*c* side. Furthermore, a fixing recess 24*c* and fixing projection 23*d*2, along with a separation wall 24*d* and a movement restricting portion 23*d*3, are formed on the elastic deformation portion 23*a*, 23*b* side.

The receptacle contact 23 group is not provided with wide contacts corresponding to the wide plug contacts 13W in the plug contact 13 group on the movable housing 12 side. A specific number (three rows in this embodiment) of receptacle contacts 23 at either side of the receptacle contact 23 group contact the wide plug contacts 13W. Wide contacts corresponding to the wide plug contacts 13W may be provided at either side of the receptacle contact 23 group.

When connecting the above-described plug connector 10 (first board B1) and receptacle connector 20 (second board B2), the pair of insertion plates 12*a*2 of the movable housing 12 are mated with the pair of receptacle recesses 22 of the housing 21. At this time, the guiding inclined face 22*a* of the entrance to the receptacle recess 22 engages with the guiding projection 12*a*6 and the guiding inclined face 12*a*7 of the outer portion 12*a* of the movable housing 12, and the insertion plates 12*a*2 can be smoothly guided into the receptacle recesses 22. The plug contact 13 group supported by the insertion plates 12*a*2 then becomes conductive while causing the elastic deformation portions 23*a*, 23*b* of the receptacle contacts 23, which are exposed inside the receptacle recesses 22, to deform elastically. Consequently, the circuit on the first board B1 and the circuit on the second board B2 are connected. FIG. 9 illustrates the elastic deformation portions 23*a*, 23*b* of the receptacle contact 23 in a free state without elastic deformation.

During this insertion and connection operation, a force acts on the movable housing 12 downward and in another direction, so that the elastic deformation portion 13*d* of the plug contact 13 deforms elastically. In particular, the movable housing 12 is movable in the sinking direction in the present embodiment. Hence, a tilting or rotating movement is possible in the sunken state, allowing the connection operation to be performed smoothly. In greater detail, the elastic deformation portion 13*d* is a portion that does not engage with (is not inserted into) any support groove (deformation suppressing groove), including the storage fixing groove 11*a*5 of the fixed housing 11 and the contact support groove 12*a*4 of the movable housing 12, and can freely deform elastically, as described above. Floating in the longitudinal direction of the movable housing 12 is produced by elastic deformation in a direction perpendicular to the paper (drawing surface) in FIG. 6, which illustrates the elastic deformation portion 13*d* of the plug contact 13. Floating in the sinking direction (the pushing direction, which approaches the first board B1), the left-right direction (including torsional motion), and the rotation direction is produced by elastic deformation of the inverted U-shaped portion 13*d*1 in the left-right direction and elastic deformation of the diagonally downward extension 13*d*2, U-shaped fold 13*d*3, and diagonally upward extension 13*d*4. At this time, the diagonally upward extension 13*d*4 heightens the function of facilitating elastic deformation and left-right movement of the U-shaped fold 13*d*3. In greater detail, a connecting portion 13*d*5 connecting the lower end of the U-shaped portion 13*b* and the diagonally upward extension 13*d*4 illustrated in FIG. 6, or some location inside the diagonally upward extension 13*d*4, becomes a pivot point, and the angle of a connecting portion (bent portion) 13*d*6 between the diagonally upward extension 13*d*4 and the U-shaped fold 13*d*3 changes. As a result, stress is dispersed, and swinging of the elastic deformation portion 13*d* is facilitated. The bent portion 13*d*6 may also occur somewhere in the diagonally upward extension 13*d*4 or somewhere in the U-shaped fold 13*d*3. Furthermore, since the floating deforming portion 13*c*1 is separated from the longitudinal walls 11*a*, the left-right movement of the inverted U-shaped portion 13*d*1 itself is not restricted. Accordingly, the elastic deformation portion 13*d* allows flexible movement particularly in the up-down direction of the movable housing 12.

Figure 4:
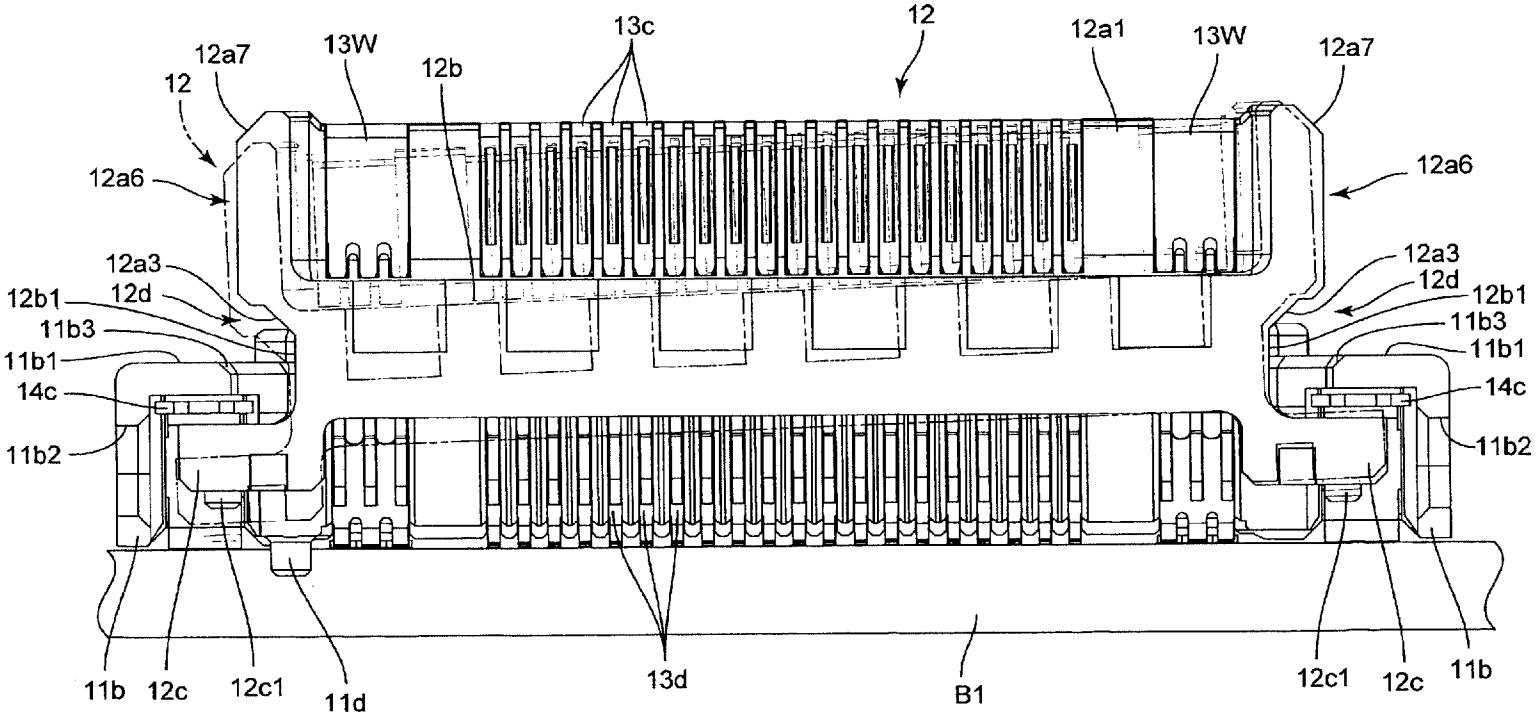
FIG. 4 is a cross-sectional view along the IV-IV line in FIG. 1.

By the above-described elastic deformation of the elastic deformation portion 13*d* and the floating deforming portion 13*c*1, the contact state between the U-shaped fold 13*d*3 and the tip contact portions 23*a*1, 23*b*1 can be maintained, and the movable housing 12 and fixed housing 11 can float in a state without relative movement of the contact portion (a state in which the contact portion does not slide). In FIG. 4 and FIG. 6, the floating movable housing 12 is indicated by dashed double-dotted lines, excluding the plug contacts 13 and the like.

The downward movement end of the movable housing 12 is restricted by the position of abutment between the stopper projections 12*c*1 of the retaining projection 12*c* and the first board B1. The movement end of the movable housing 12 in the longitudinal direction and the left-right direction is restricted by the position of abutment between the stopper face 12*b*1 and the inner surface of the board-facing plate 11*b*1. The amount of movement in the left-right direction is restricted by the position of abutment between the outer surface of the inner portion 12*b* and the opening restriction edge (projection) 11*a*1. The elastic force of the elastic deformation portion 13*d* of the plug contact 13 may, however, be adjusted so that the plug connector 10 and the receptacle connector 20 can be completely mated without the retaining projection 12*c* reaching the position of abutment (restriction position) with the first board B1. The movable housing 12 thus being movable in the pushing and removal direction increases the tolerance with respect to misalignment of the first board B1 and second board B2. The risk of connector damage due to a colliding force at the time of fitting can also be avoided.

On the other hand, when removing the plug connector 10 from the receptacle connector 20, the movable housing 12 moves upward relative to the fixed housing 11. The upward movement end of this movement is restricted by the position of abutment between the upper surface of the retaining projections 12*c* and the retaining plate 14*c* of the retaining bracket 14. A reduction in size of the fixed housing 11 is desired, and thinning of the board-facing plate 11*b*1 is also required. Promoting retention of the retaining projection 12*c* of the movable housing 12 with the retaining plate 14*c* of the retaining bracket 14 in this way reliably promotes retention without risk of damage to the fixed housing 11 (board-facing plate 11*b*1).

When the amount of floating is large (in this example, an allowable movement of approximately 1 mm to one side in the longitudinal direction relative to a pitch of 0.5 mm) during mating while floating the movable housing 12 relative to the fixed housing 11, the amount of deformation of the elastic deformation portion 13*d* in the plug contact 13, which is four-cornered in plan view of the movable housing 12, increases. Hence, the distance between adjacent plug contacts 13 might become extremely small. The wide plug contact 13W as one plug contact that has a plurality of elastic deformation portions 13Wd is disposed at the four corners of the movable housing 12, thereby allowing use for protecting the narrow (signal transmission) plug contacts 13 in the intermediate portion. In other words, providing the plurality of elastic deformation portions 13Wd (three in the illustrated embodiment) relative to one U-shaped portion 13Wb of the wide plug contact 13W can protect the narrow (signal transmission) plug contacts 13 in the intermediate portion without sacrificing floatability. One of the wide plug contacts 13W can also be used as one circuit, as a ground terminal or a power source terminal.

The position of the tip of the wide plug contact 13W in the mating direction may be shifted from the position of the tip of the plug contact 13. For example, when used as a ground terminal, the wide plug contact 13W is preferably contacted to the receptacle contact 23 before the remaining narrow (signal transmission) plug contacts 13 during connection of the plug connector 10 and the receptacle connector 20. Therefore, as illustrated by the dashed line in FIG. 2, the wide plug contact 13W can come into contact first with the tip of the corresponding ground terminal among the receptacle contacts 23 by the U-shaped portion 13Wb being formed with a greater upward projection amount than the upward projection amount of the U-shaped portion 13*b* of the narrow (signal transmission) plug contacts 13. The receptacle contact 23 is contacted by the wide plug contact 13W and then by the narrow (signal transmission) plug contacts 13, so that grounding has already been achieved when a signal flows to the narrow (signal transmission) plug contacts 13.

When the wide plug contact 13W is used as a power source terminal, the remaining narrow (signal transmission) plug contacts 13 first contact the receptacle contacts 23, with the wide plug contact 13W subsequently contacting the receptacle contact 23, during connection of the plug connector 10 and the receptacle connector 20. This order of contact allows power to flow after the narrow (signal transmission) plug contacts 13 contact the receptacle contact 23. In other words, all of the narrow (signal transmission) plug contacts 13 are in a state capable of conduction when power flows. In this case, the wide plug contact 13W can come into contact later with the corresponding power source terminal among the receptacle contacts 23 by the U-shaped portion 13Wb of the wide plug contact 13W being formed with a smaller upward projection amount than the upward projection amount of the U-shaped portion 13*b* of the narrow (signal transmission) plug contacts 13.

One of the wide plug contacts 13W in the pair may be the aforementioned ground terminal, and the other may be the aforementioned power source terminal.

An example of the fixing structure of the receptacle contact 23 to the housing 21 (storage grooves 24) has been illustrated with the above embodiment, but modifications are possible. In particular, the second board B2 and the first board B1 are parallel in the illustrated example. However, the second board B2 and the first board B1 may be orthogonal to each other. In this case, the connection fixing portion 23*d* (and the housing 21 and storage grooves 24) may be changed to a corresponding shape.

The plug connector 10 is formed by the fixed housing 11 and the movable housing 12 in the above embodiment, but the receptacle connector 20 side may be formed by a fixed housing and a movable housing.

REFERENCE SIGNS LIST

B1 First board (board)
B2 Second board (board)
10 Plug connector (floating connector device)
11 Fixed housing
11*a* Longitudinal wall
11*a*1 Opening restriction edge (projection)
11*a*2 Cutout
11*a*3 Storage fixing groove
11*a*4 Cutout
11*a*5 Storage fixing groove
11*b* Transverse wall
11*b*1 Board-facing plate
11*b*2 Opening
11*b*3 Chamfered portion
11*c* Long through-hole
11*d* Positioning projection
12 Movable housing
12*a* Outer portion
12*a*1 Long bottomed hole
12*a*2 Insertion plate
12*a*3 Tapered face
12*a*4 Contact support groove
12*a*5 Wide contact support groove
12*a*6 Guiding projection
12*a*7 Guiding inclined face
12*b* Inner portion
12*b*1 Stopper face
12*c* Retaining projection
12*c*1 Stopper projection
13 Plug contact (contact group)
13W Wide plug contact
13*a*, 13Wa Tail
13*b*, 13Wb U-shaped portion
13*c* Fixing portion
13*c*1 Floating deforming portion
13*d* Elastic deformation portion
13*d*1 Inverted U-shaped portion
13*d*2 Diagonally downward extension
13*d*3 U-shaped fold
13*d*4 Diagonally upward extension
14 Retaining bracket
14*a* Tail
14*b* Fixing portion
14*c* Retaining plate
20 Receptacle connector
21 Housing
22 Receptacle recess
23 Receptacle contact (contact group)
23*a*, 23*b* Elastic deformation portion
23*a*1, 23*b*1 Tip contact portion
23*c* Tail
23*d* Connection fixing portion
23*d*1 Fixing recess
23*d*2 Fixing projection
23*d*3 Movement restricting portion
23*d*4 Slit
23*d*5 Connecting portion
23*e* Linking portion

24 Storage groove
24*a* Deformation allowance groove
24*b* Fixing projection
24*c* Fixing recess
24*d* Separation wall

The invention claimed is:

1. A floating connector device comprising a fixed housing for fixing to a board, a movable housing movable with respect to said fixed housing, and a contact group with one end for fixing in a row to said board and another end for fixing in a row to said movable housing in a longitudinal direction of said movable housing; wherein said fixed housing comprises a long through-hole and a pair of board-facing plates, positioned at longitudinal ends of said long through-hole, facing said board;

said movable housing comprises an outer portion projecting from said long through-hole of said fixed housing and a retaining projection positioned farther on the board side than said board-facing plates and overlapping said board-facing plates in plan view;

said contact group comprises a tail for mounting on said board, a fixing portion supported by a storage fixing groove of said fixed housing, a U-shaped portion supported by a contact support groove formed in said outer portion of said movable housing, and a first elastic deformation portion, connecting said fixing portion and said U-shaped portion, in a free state unsupported by either groove;

said elastic deformation portion, by elasticity thereof in said free state, separates said movable housing from said board, allows said movable housing to sink in a direction of the board, and in a sunken state, allows elastic movement in said longitudinal direction of said movable housing, a direction orthogonal to said longitudinal direction, and a tilting direction, wherein said elastic deformation portion of said contact group comprises an inverted U-shaped portion, a diagonally downward extension, a U-shaped fold, and a diagonally upward extension in this order from a fixing portion side that fixes to said fixed housing; and a stopper projection formed on the retaining projection of the movable housing, wherein the stopper projection is located closer to the board than the U-shaped fold.

2. The floating connector device of claim 1, wherein a retaining bracket positioned on an inside of said board-facing plates is positioned on said fixed housing, and said retaining bracket comprises a pair of tails for mounting on a board, a pair of fixing portions extending along an inner surface of said fixed housing, and a retaining plate connecting said pair of fixing portions and overlapping with said retaining projection of said movable housing in plan view.

3. The floating connector device of claim 1, wherein a mating connector comprising a contact group for connecting to said contact group of said floating connector device comprises elastic deformation portions forming a pair including tip contact portions to elastically contact both sides of said U-shaped portion of said contact group at different height positions.

4. The floating connector device of claim 1, wherein said contact group comprises a floating deforming portion, between said fixing portion that fixes to said fixed housing and said inverted U-shaped portion, separated from a bottom of said storage fixing groove of said fixed housing.

* * * * *